US006716308B2

(12) United States Patent
Baggot et al.

(10) Patent No.: US 6,716,308 B2
(45) Date of Patent: Apr. 6, 2004

(54) METHOD FOR CALENDERING AN UNCREPED THROUGHDRIED TISSUE SHEET

(75) Inventors: James Leo Baggot, Menasha, WI (US); Tony Deadman, Tonbridge (GB); Ronald Frederick Gropp, St. Catharines (CA); Frank Stephen Hada, Appleton, WI (US); Robert James Seymour, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 502 days.

(21) Appl. No.: 09/736,925

(22) Filed: Dec. 14, 2000

(65) Prior Publication Data

US 2002/0074684 A1 Jun. 20, 2002

(51) Int. Cl.[7] ..... D21F 11/00

(52) U.S. Cl. ..... 162/109; 162/117; 162/118; 162/134; 162/135; 162/184; 162/202; 162/205; 162/206

(58) Field of Search ..... 162/109, 117, 162/135, 134, 118, 205, 206

(56) References Cited

U.S. PATENT DOCUMENTS

| | | | | | |
|---|---|---|---|---|---|
| 4,087,319 | A | * | 5/1978 | Linkletter | 162/113 |
| 5,048,589 | A | | 9/1991 | Cook et al. | |
| 5,591,309 | A | * | 1/1997 | Rugowski et al. | 162/283 |
| 5,593,545 | A | | 1/1997 | Rugowski et al. | |
| 5,601,871 | A | * | 2/1997 | Krzysik et al. | 428/288 |
| 5,672,248 | A | * | 9/1997 | Wendt et al. | 162/109 |
| 5,759,346 | A | | 6/1998 | Vinson | |
| 5,888,347 | A | | 3/1999 | Engel et al. | |

* cited by examiner

*Primary Examiner*—Peter Chin
(74) *Attorney, Agent, or Firm*—Gregory E. Croft

(57) ABSTRACT

A method of compressively modifying, such as by calendering, an uncreped throughdried tissue sheet is disclosed. The dried tissue sheet, initially supported by the throughdrying fabric, is removed from the throughdrying fabric and compressively modified. Thereafter, the compressively modified sheet is recombined with a papermaking fabric and carried to a reel section while supported by the fabric. The sheet is always, or substantially always, supported by a fabric or a roll surface to minimize opportunities for sheet breaks or otherwise adversely affecting sheet properties.

17 Claims, 7 Drawing Sheets

METHOD FOR CALENDERING AN UNCREPED THROUGHDRIED TISSUE SHEET

BACKGROUND OF THE INVENTION

Calendering is a standard process for converting or processing paper that is typically done between the Yankee dryer and the reel section of a conventional tissue machine. In these machines, the area between the Yankee dryer and the reel section of the tissue machine has an open draw where the dried tissue sheet is unsupported. With such an arrangement, a calender section can be inserted into this open area to calender the sheet prior to winding the sheet onto the reel.

More recently, uncreped throughdried tissue machines have been designed in which the dried tissue sheet is carried from the throughdryer to the reel section on a belt or fabric without an open draw. An example of such a machine is described in U.S. Pat. No. 5,593,545 issued Jan. 14, 1997 to Rugowski et al., which is hereby incorporated by reference. In the reel section of such a machine, which is sometimes referred to as a belted reel section, the parent roll of tissue is wound directly against the supporting belt or fabric. As a consequence, there is no open draw area into which a calendering station can be inserted in order to calender the sheet. This can be disadvantageous if a more smooth parent roll tissue surface is desired or if there is a desire to reduce or control the bulk of the sheet or other sheet properties, such as softness, at this point in the process rather than later during converting operations.

Therefore, there is a need for an apparatus and method for calendering a tissue sheet on a tissue machine having a belted reel section.

SUMMARY OF THE INVENTION

It has now been discovered that an uncreped tissue sheet, produced on a tissue machine having a belted reel section, can be modified (calendered, embossed, pressed, crimped, printed, chemically treated or otherwise acted upon in a nip between two rolls) while remaining completely supported by either fabrics or rolls. The supporting fabric or fabrics which move the sheet from the throughdryer to the reel section can be the throughdrying fabric or one or more dry end transfer fabrics.

More specifically, in one aspect, the invention resides in a method for modifying an uncreped throughdried tissue sheet supported by a papermaking fabric, said method comprising removing the dried tissue sheet from the papermaking fabric, modifying the tissue sheet, particularly compressively modifying the tissue sheet in a nip between two rolls, and transferring the modified or compressively modified sheet to a papermaking fabric which carries the sheet to a reel section for winding the sheet into a parent roll, wherein the sheet is supported at all times by a roll surface or a supporting fabric. In this aspect of the invention and those described below, any compressive modification step can be carried out between any combination of steel and rubber rolls, such as steel/steel, steel/rubber or rubber/rubber. The rolls can be smooth or engraved, matched or unmatched.

In another aspect, the invention resides in a method for compressively modifying an uncreped throughdried tissue sheet supported by a papermaking fabric, said method comprising removing the dried tissue sheet from the papermaking fabric via a vacuum transfer roll, contacting the sheet with the surface of a rubber-covered backing roll, passing the sheet through a nip between the rubber-covered backing roll and a steel roll, and transferring the compressively modified sheet to a papermaking fabric which carries the sheet to the reel section for winding the sheet into a parent roll.

In another aspect, the invention resides in a method for compressively modifying an uncreped throughdried tissue sheet supported by a papermaking fabric, said method comprising removing the dried tissue sheet from the papermaking fabric, compressively modifying the tissue sheet, and transferring the compressively modified sheet to a papermaking fabric which carries the sheet to the reel section for winding the sheet into a parent roll, wherein, prior to removal of the dried tissue sheet from the papermaking fabric, the dried tissue sheet is sandwiched between the papermaking fabric and a second papermaking fabric, said method further comprising separating the tissue sheet and the second papermaking fabric from the papermaking fabric via a vacuum transfer roll such that the second papermaking fabric is in direct contact with the surface of the vacuum transfer roll, transferring the second papermaking fabric and the tissue sheet to a steel roll such that the tissue sheet is in direct contact with the surface of the steel roll, separating the second papermaking fabric from the tissue sheet, passing the tissue sheet through a nip between the steel roll and a rubber-covered backing roll to compressively modify the sheet, and transferring the compressively modified tissue sheet from the rubber-covered backing roll to the papermaking fabric that carries the tissue sheet to the reel.

In another aspect, the invention resides in a method for compressively modifying an uncreped throughdried tissue sheet supported by a papermaking fabric, said method comprising transferring the dried sheet from the papermaking fabric to a steel roll via a vacuum transfer roll, passing the sheet through a nip between the steel roll and a rubber-covered backing roll, and transferring the compressively modified sheet, via a second vacuum transfer roll, to a papermaking fabric that carries the sheet to the reel.

In another aspect, the invention resides in a method for compressively modifying an uncreped throughdried tissue sheet supported by a papermaking fabric comprising removing the dried tissue sheet from the papermaking fabric, passing the tissue sheet over a support surface, passing the tissue sheet through a nip between a steel roll and a rubber-coated backing roll, passing the resulting compressively modified sheet over a second support surface, and joining the sheet with a papermaking fabric which carries the sheet to the reel section.

In another aspect, the invention resides in a method for compressively modifying an uncreped throughdried tissue sheet supported by a papermaking fabric comprising contacting the throughdried tissue sheet, while still in contact with the papermaking fabric, with a first roll, separating the tissue sheet from the papermaking fabric, passing the sheet through a nip formed between the first roll and a second roll while travelling in a direction opposite the machine direction of travel, transferring the resulting compressively modified sheet to the surface of the second roll and reversing the direction of travel of the sheet while in contact with the second roll, separating the sheet from the second roll and joining the compressively modified sheet with a papermaking fabric that carries the compressively modified sheet to the reel section.

In all aspects of the invention described above and shown in the Figures, the various sheet modification rolls can be calendering rolls, embossing rolls or printing rolls and the like in order to modify the tissue sheet in any desired manner. Calendering rolls can be used to control the caliper of the sheet and improve softness. Embossing rolls, of course, can be used to impart patterns to the sheet. Printing rolls, such as gravure rolls, can be used to print inks or other chemicals, such as softening chemicals, onto the surface of the sheet. Calendering rolls are particularly suitable for compressively modifying the sheet in accordance with this invention.

As used herein, the term "tissue sheet" includes paper webs having a basis weight and bulk appropriate for use as facial tissue, bath tissue, paper towels, dinner napkins and the like.

These and other aspects of the invention will be described in greater detail with reference to the drawing.

DETAILED DESCRIPTION OF THE DRAWINGS

Figure 1:
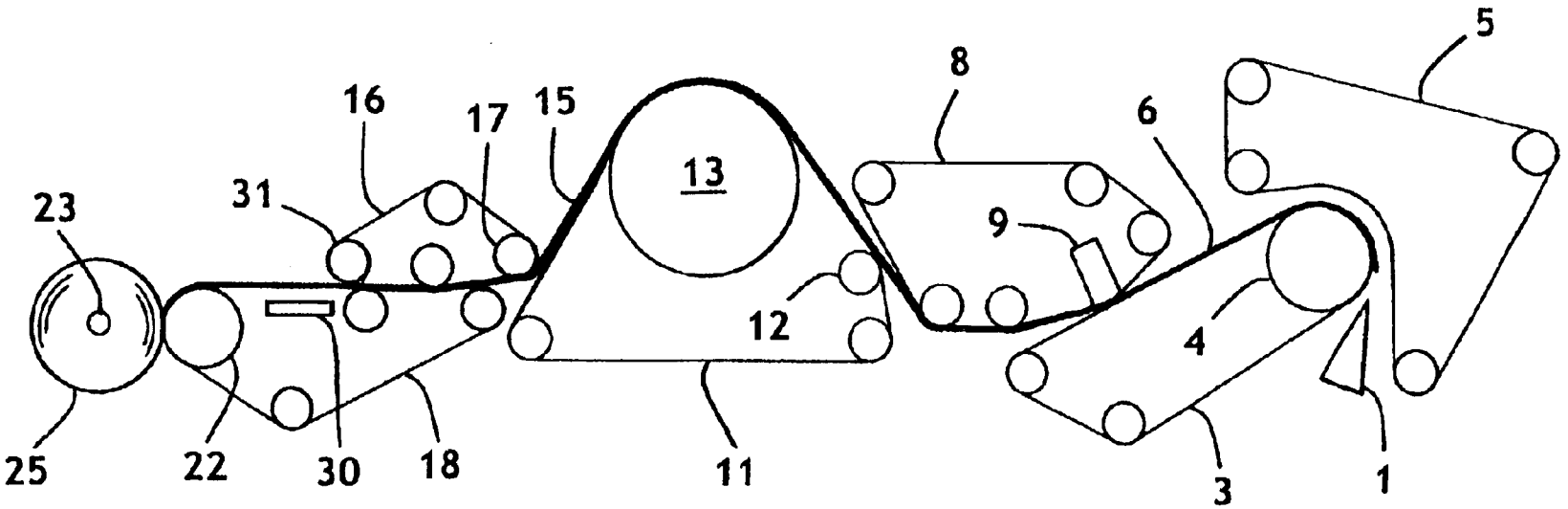
FIG. 1 is a schematic diagram of an uncreped throughdried tissue machine as disclosed in FIG. 2 of U.S. Pat. No. 5,593,545 issued Jan. 14, 1997 to Rugowski et al., previously incorporated herein by reference, to which this invention is applicable.

FIG. 1 illustrates a schematic flow diagram of a representative throughdrying process for making uncreped throughdried tissues to which this invention can be applied. Shown is the headbox 1 which deposits an aqueous suspension of papermaking fibers onto inner forming fabric 3 as it traverses the forming roll 4. Outer forming fabric 5 serves to contain the web while it passes over the forming roll and sheds some of the water. The wet web 6 is then transferred from the inner forming fabric to a wet end transfer fabric 8 with the aid of a vacuum transfer shoe 9. This transfer is preferably carried out with the transfer fabric travelling at a slower speed than the forming fabric (rush transfer) to impart stretch into the final tissue sheet. The wet web is then transferred to the throughdrying fabric 11 with the assistance of a vacuum transfer roll 12. The throughdrying fabric carries the web over the throughdryer 13, blows hot air through the web to dry it while preserving bulk. There can be more than one throughdryer in series (not shown), depending on the speed and the dryer capacity. As the dried tissue sheet 15 leaves the throughdryer fabric, it is transferred to a first dry end transfer fabric 16 with the aid of a vacuum transfer roll 17. Suitable fabrics for use as the first dry end transfer fabric 16 include, without limitation, a wide variety of fabrics such as Asten 934, Asten 939, Albany 59M, Albany Duotex DD207, Lindsay 543 and the like. The tissue sheet is then compressed between the first dry end transfer fabric and a second dry end transfer fabric 18, which has a greater air permeability than that of the first dry end transfer fabric and which wraps around the reel drum 22. Suitable second dry end transfer fabrics include, without limitation, Asten 960 (air permeability of about 300–400), Appleton Mills style Q53F (air permeability of about 400), Appleton Mills style Q53KY (air permeability of about 200), Albany Duotex A81 and Appleton Mills style HC200 (air permeability of about 200). Because of the air flow through the lower fabric caused by roll 31, the sheet transfers to the second dry end transfer fabric 18. It is retained on the top surface of the second dry end transfer fabric by air pressure generated by the presence of an air foil 30 on the underside of the fabric. The tissue sheet is then carried to the winding nip formed between the reel drum and the reel 23 and wound into a roll 25.

Figure 2:
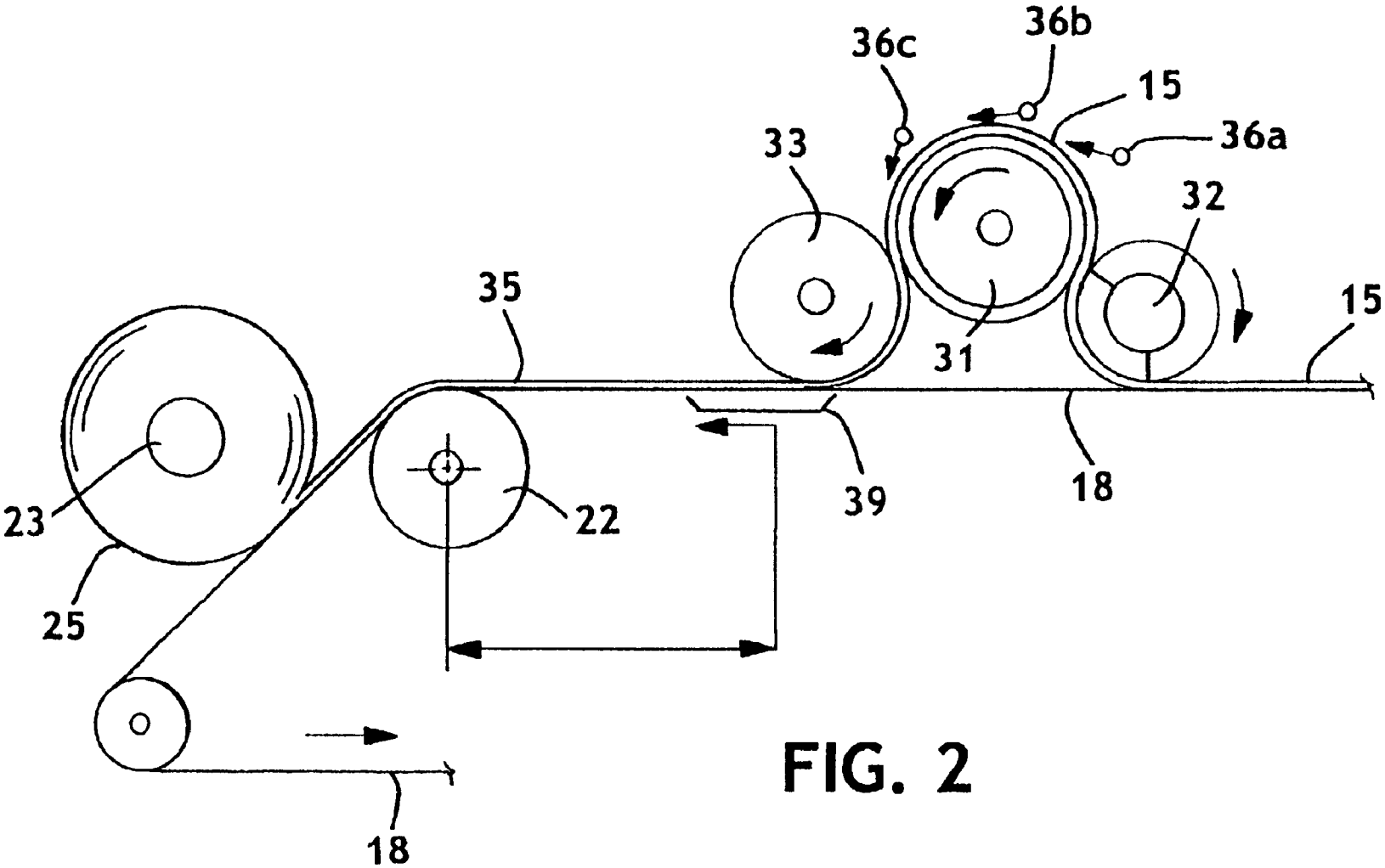
FIG. 2 is a schematic diagram of one embodiment of this invention, in which the dried tissue sheet is temporarily separated from the supporting fabric using a vacuum transfer roll and is thereafter calendered by passing the sheet through a nip between a rubber-covered backing roll and a steel calendering roll before being returned to the supporting fabric.

FIG. 2 illustrates one embodiment of this invention. As with all of the embodiments illustrated herein, the front end of the overall papermaking process can be as illustrated in FIG. 1. For convenience, the use of the same reference numbers in the various figures is intended to represent the same features. Shown in FIG. 2 is the dried tissue sheet 15, supported by the second dry end transfer fabric 18, being transferred to a rubber-coated embossing roll 31 via a vacuum transfer roll 32. The tissue sheet then passes through the calendering nip formed between the rubber-coated calendering roll and a steel calendering roll 33, before being placed in contact again with the second dry end transfer fabric with the aid of a vacuum box 39. For this embodiment and the others described herein, the steel calender roll 33 and the rubber-covered calender roll 31 can be interchanged to impart different surface properties to the sheet. The second dry end transfer fabric carries the calendered tissue sheet 35 to the reel, where it is wound into a parent roll for subsequent converting operations. Optional air showers **36*a*, 36*b* and 36*c* are also shown, which aid in threading the tissue sheet into the calender nip during startup. The steel calendering roll 33** can be loaded to apply the desired pressure to the calendering nip, or the steel roll can be positioned to provide a fixed-gap nip. Desirably, the papermaking fabric carrying the sheet to the calendering station and the papermaking fabric carrying the calendered sheet to the reel station is the same fabric, preferably the second dry end transfer fabric or the throughdrying fabric, in order to minimize the number of fabric runs on the machine. As shown, the entire time the sheet is in the calendering station, from the time the sheet is removed from the papermaking fabric until the time the sheet is brought into contact with the papermaking fabric that carries the sheet to the reel section, the sheet is substantially in contact with a roll surface, fully supporting the sheet and thereby minimizing the chances for a sheet break or deleterious effects on important sheet properties such as machine-direction tensile strength.

Figure 3:
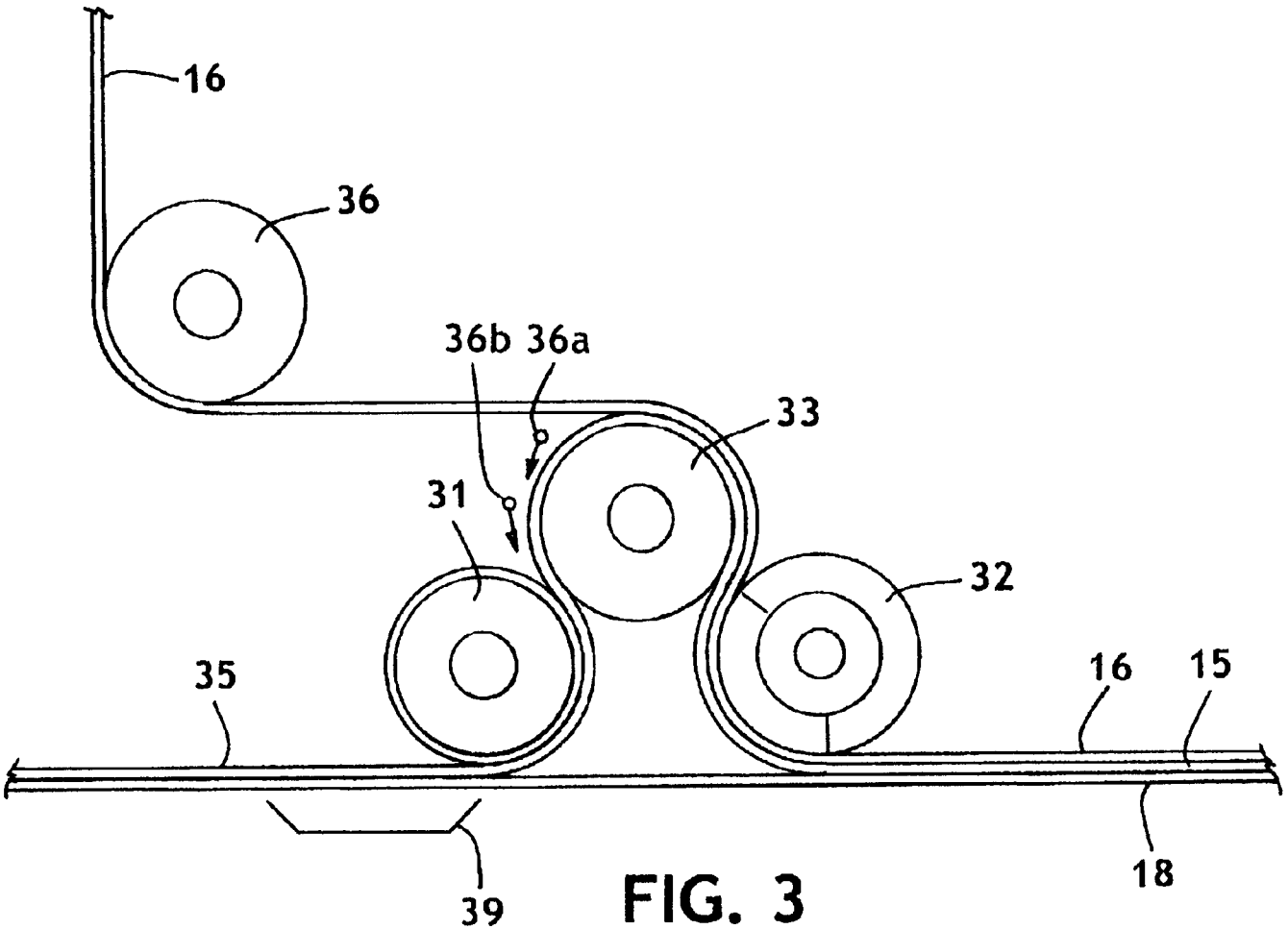
FIG. 3 is a schematic diagram of another embodiment of this invention, in which the calendering step is carried out while the sheet is positioned against a supporting fabric.

FIG. 3 illustrates an alternative embodiment, where the dried tissue sheet 15 enters the calendering station while sandwiched between two papermaking fabrics, namely the first dry end transfer fabric 16 and the second dry end transfer fabric 18. As shown, the sheet and the first dry end transfer fabric 16 are separated from the second dry end transfer fabric 18 utilizing a vacuum transfer roll 32. The sheet and the first dry end transfer fabric transfer to the steel calender roll 33 with the sheet having direct contact with the steel roll. The first dry end transfer fabric then separates from the sheet and returns toward the dryer section as it passes around the return roll 36. In the meantime, the sheet passes through the calendering nip formed between the steel roll and the rubber-covered calender roll 31. Thereafter, the calendered sheet 35 is brought into contact again with the second dry end transfer fabric 18 with the aid of a vacuum box 39 and carried to the reel section as illustrated above. Optional air showers 36*a* and 36*b* assist in the web handling.

Figure 4:
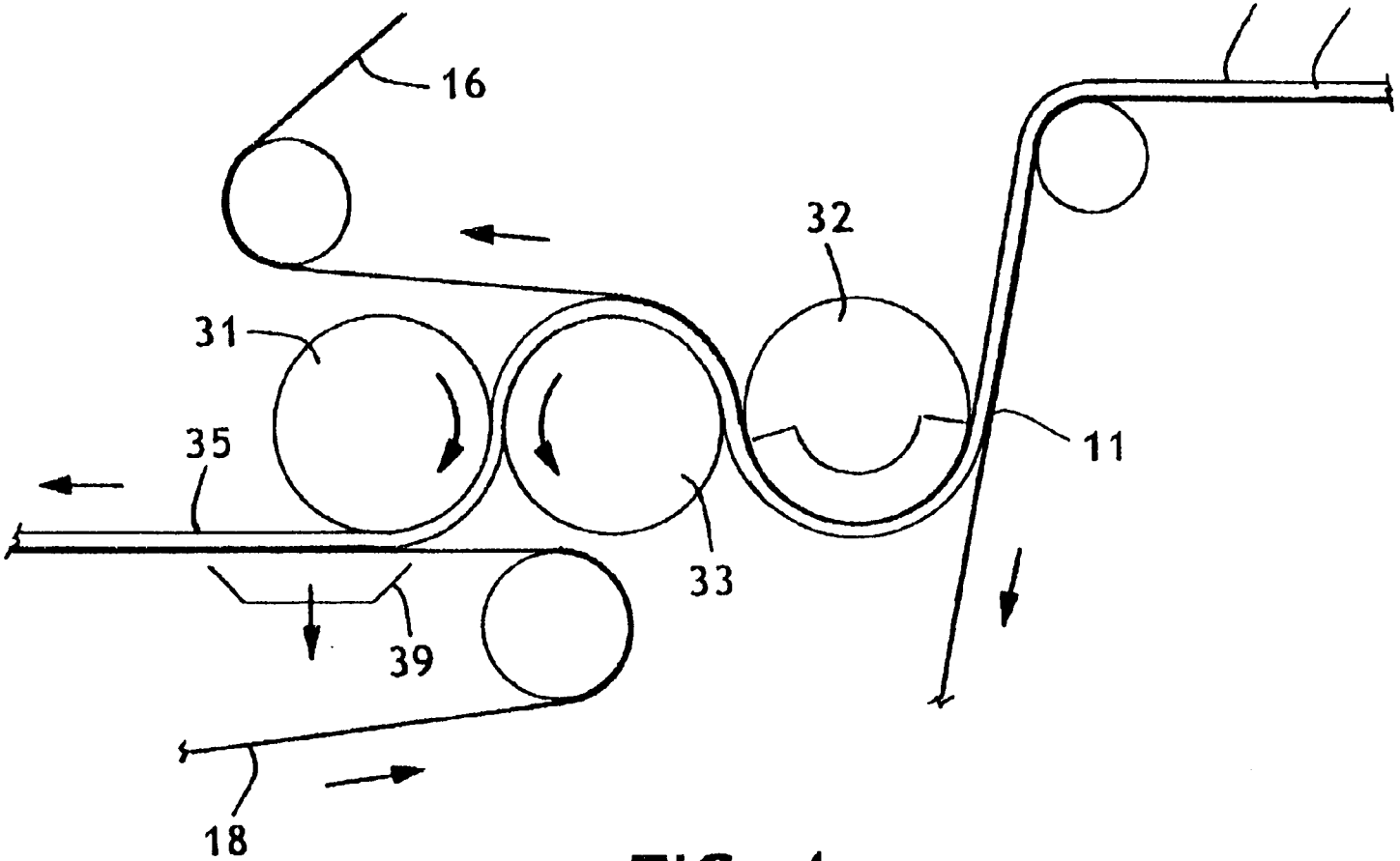
FIG. 4 is similar to FIG. 3, but where the sheet is calendered after being removed from the one supporting fabric and thereafter transferred to another supporting fabric.

FIG. 4 illustrates an alternative embodiment in which the dried tissue sheet 15 enters the calendering station while sandwiched between two papermaking fabrics, namely the first dry end transfer fabric 16 and the throughdrying fabric 11. As shown, the sheet and the first dry end transfer fabric 16 are separated from the throughdrying fabric 11 utilizing a vacuum transfer roll 32. The sheet and the first dry end transfer fabric transfer to the steel calender roll 33 with the sheet having direct contact with the steel roll. The first dry end transfer fabric then separates from the sheet and returns toward the dryer section as it passes around the return roll 36. In the meantime, the sheet passes through the calendering nip formed between the steel roll and the rubber-covered calender roll 31. Thereafter, the calendered sheet 35 is brought into contact with the second dry end transfer fabric 18 with the aid of a vacuum box 39 and carried to the reel section as illustrated above.

Figure 5:
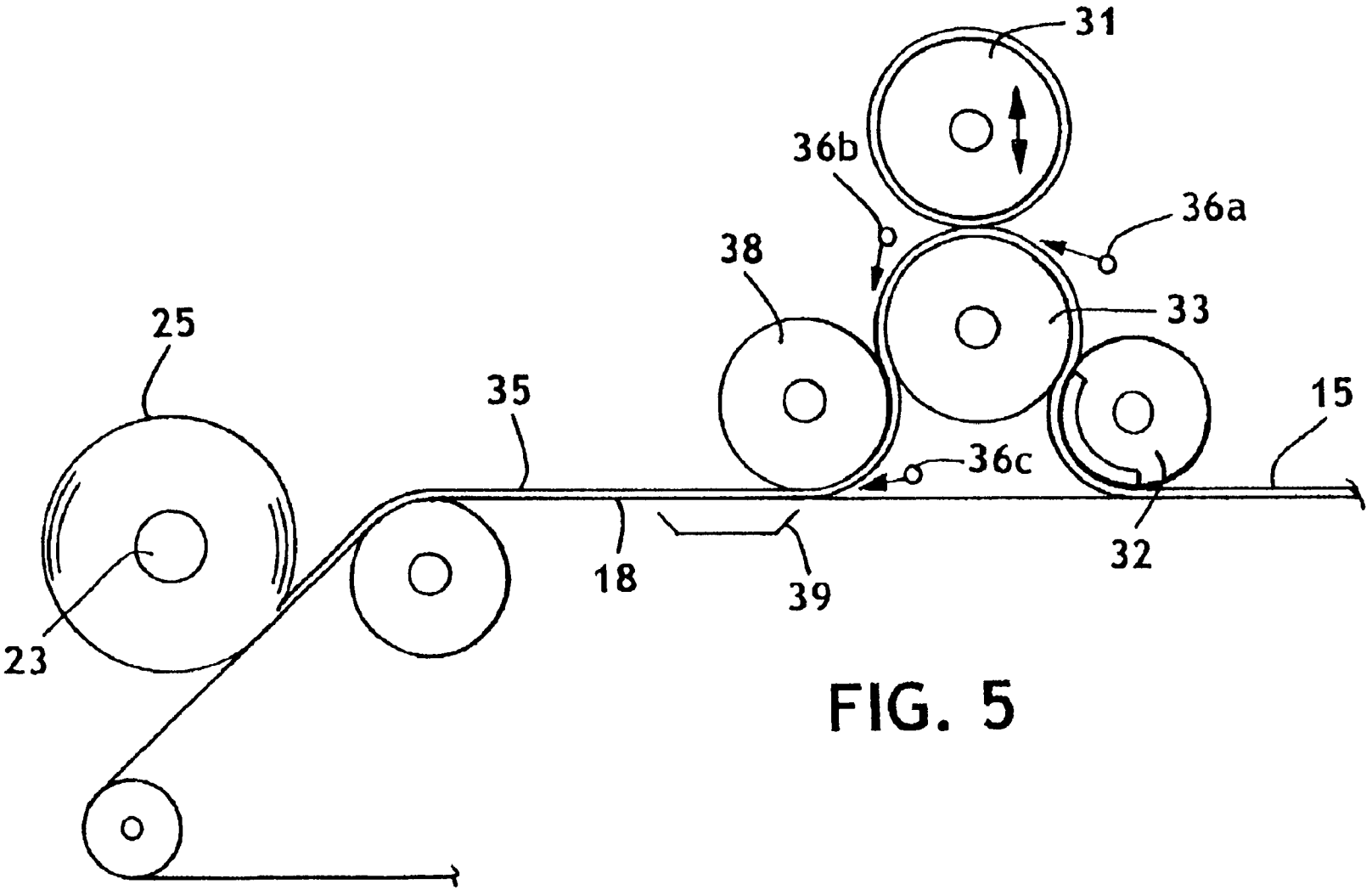
FIG. 5 is a schematic diagram of another embodiment of this invention, in which the rubber-covered backing roll is mounted above the steel calendering roll and a second vacuum transfer roll is used to transfer the calendered sheet back to the same supporting fabric.

FIG. 5 illustrates another embodiment in which the dried sheet is transferred from a papermaking fabric, such as the second dry end transfer fabric or the throughdrying fabric, to a steel calendering roll 33 via a vacuum transfer roll 32. The dried sheet passes through the calendering nip between the steel calendering roll and a vertically-oriented rubber-covered calendering roll 31. Thereafter, the calendered sheet 35 is transferred to a papermaking fabric, such as the second wet end transfer fabric, using a second vacuum transfer roll 38 and/or vacuum box 39 and carried to the reel section as illustrated above. Air showers 36*a*, 36*b* and 36*c* assist in the various transfers.

Figure 6:
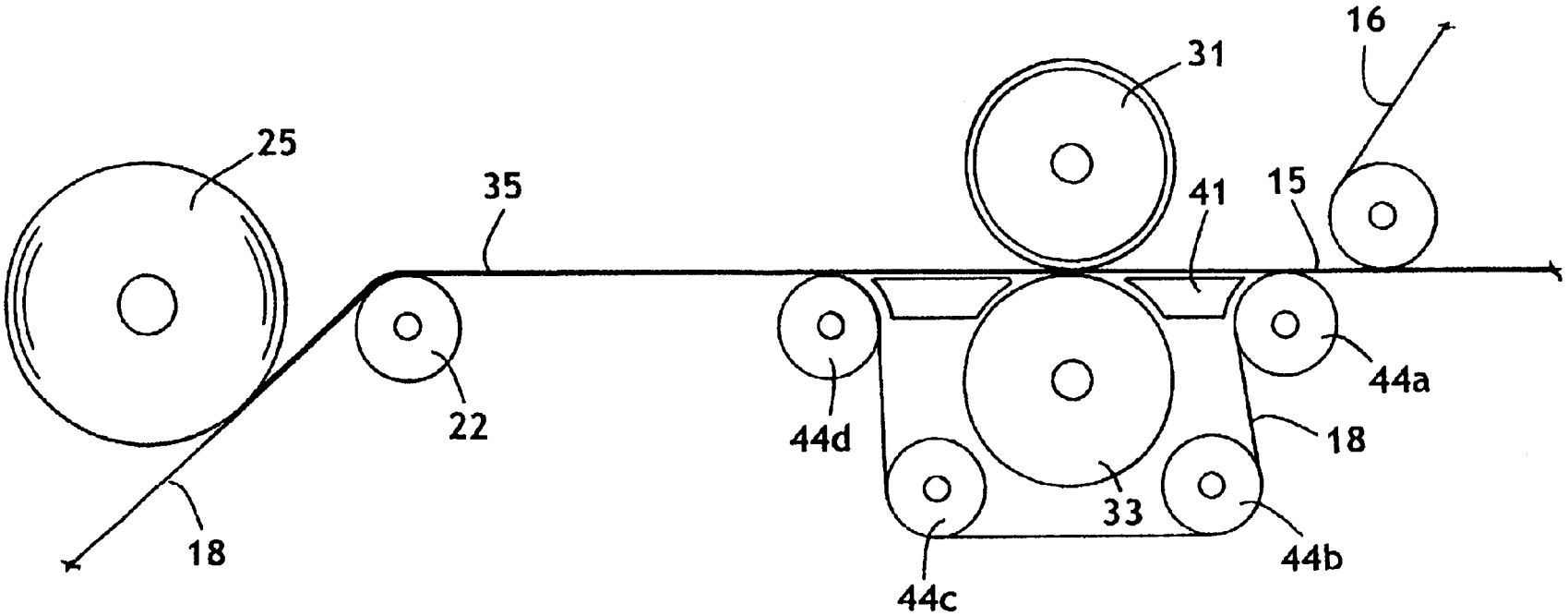
FIG. 6 is a schematic diagram of another embodiment of this invention, in which the supporting fabric is diverted around the calendering rolls while the sheet is directed through the calendering nip using one or more air foils to maintain substantially continuous support of the sheet.

FIG. 6 illustrates another embodiment in which the dried sheet is separated from the second dry end transfer fabric and passed over a first support surface 41. The support surface can be any surface that minimizes or reduces sheet flutter, including such structures as support boxes or air foils. The sheet is passed through a calendering nip between first and second calendering rolls, one of which is steel and the other being rubber-covered. The calendered sheet thereafter passes over a second support surface 42 and is transferred to a papermaking fabric, such as the second dry end transfer fabric as shown, and thereafter carried to the reel section. In the embodiment illustrated, the second dry end transfer fabric by-passes the calendering section using multiple fabric carrying rolls 44*a*, 44*b*, 44*c* and 44*d*.

Figure 7:
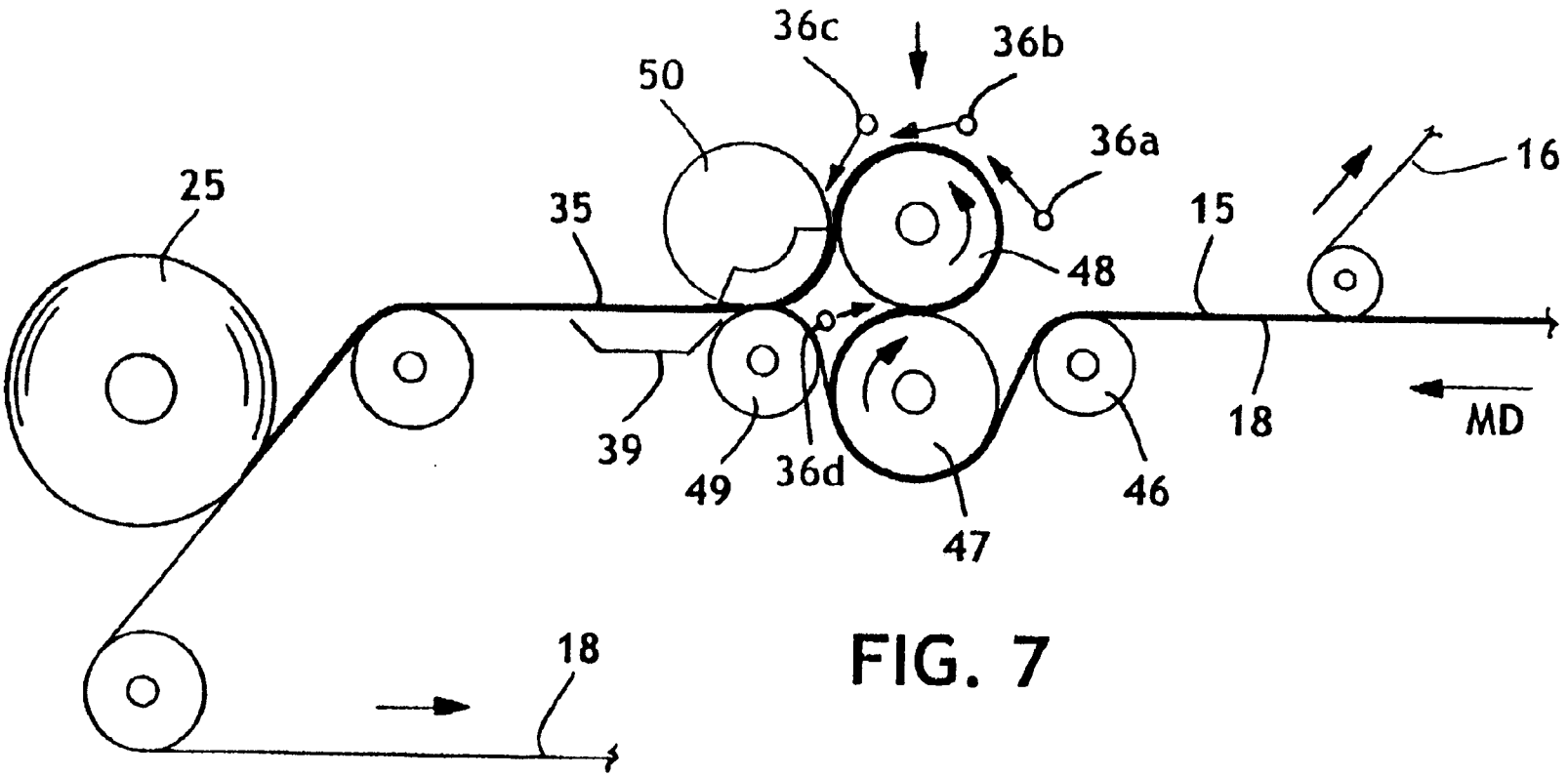
FIG. 7 is a schematic diagram of another embodiment of this invention, in which the supporting fabric remains in contact with the sheet while the sheet contacts the first calendering roll prior to the calendering nip and is rejoined with the sheet after the sheet passes through the calendering nip and is carried around the second calendering roll.

FIG. 7 illustrates another embodiment of this invention wherein the dried tissue web, while supported by the second dry end transfer fabric 18 or throughdrying fabric and traveling in the machine direction (indicated by the arrow labeled "MD"), passes over roll 46 and is carried around a first calendering roll 47, which can either be steel or rubber-covered. While in contact with the calendering roll 47, the sheet separates from the papermaking fabric and enters the calendering nip between the first calendering roll and the second calendering roll 48 while the sheet is traveling in a direction which is opposite the machine direction. The second calendering roll can be either steel or rubber-covered. The calendered sheet 35 then reverses directions around the second calendering roll 48 and is placed in contact again with the second dry end transfer fabric again as the fabric passes over a second tension roll 49. The fabric then carries the calendered sheet to the reel section as described above. Web management is enhanced with optional air showers 36*a*, 36*b*, 36*c* and 36*d* as well as vacuum roll 50 and vacuum box 39.

It will be appreciated that the foregoing description and drawings, given for purposes of illustration, shall not be construed as limiting the scope of this invention, which is defined by the following claims and all equivalents thereto.

We claim:

1. A method for modifying an uncreped throughdried tissue sheet supported by a papermaking fabric, said method comprising removing the dried tissue sheet from the papermaking fabric, modifying the tissue sheet in a nip between two rolls, and transferring the modified sheet to a papermaking fabric which carries the sheet to a reel section for winding the sheet into a parent roll, wherein the sheet is supported at all times by a roll surface or a supporting fabric.

2. The method of claim 1 wherein the dried tissue sheet is compressively modified by calendering.

3. The method of claim 1 wherein the dried tissue sheet is compressively modified by embossing.

4. The method of claim 1 wherein the dried tissue sheet is modified by printing.

5. The method of claim 1 wherein from the time the tissue sheet is removed from the papermaking fabric until the time the tissue is brought into contact with the papermaking fabric that carries the sheet to the reel section, the tissue sheet is in contact with a roll surface.

6. The method of claim 2 further comprising removing the dried tissue sheet from the papermaking fabric via a vacuum transfer roll, contacting the sheet with the surface of a rubber-covered backing roll, passing the sheet through a calendering nip between the rubber-covered backing roll and a steel calendering roll, and transferring the calendered tissue sheet to the papermaking fabric that carries the calendered tissue sheet to the reel.

7. The method of claim 6 wherein the nip between the steel calendering roll and the rubber-covered backing roll is a fixed gap.

8. The method of claim 6 wherein the nip between the steel calendering roll and the rubber-covered backing roll is loaded.

9. A method for modifying an uncreped throughdried tissue sheet supported by a papermaking fabric, said method comprising sandwiching the throughdried tissue sheet between the papermaking fabric and a second papermaking fabric, separating the tissue sheet and the second papermaking fabric from the papermaking fabric via a vacuum transfer roll such that the second papermaking fabric is in direct contact with the surface of the vacuum transfer roll, transferring the second papermaking fabric and the tissue sheet to a steel calendering roll such that the tissue sheet is in direct contact with the surface of the steel calendering roll, separating the second papermaking fabric from tho tissue sheet, passing the tissue sheet through a nip between the steel calendering roll and a rubber-covered backing roil to calender the sheet, and transferring th calendered tissue sheet from the rubber-covered backing roll to the papermaking fabric that carries the calendered tissue sheet to reel section for winding the sheet into a parent roll, wherein the sheet is supported at all times by a roll surface or a supporting fabric.

10. The method of claim 9 wherein the papermaking fabric carrying the dried sheet to the vacuum transfer roll and the papermaking fabric carrying the calendered sheet to the reel are the same fabric.

11. A method for modifying an uncreped throughdried tissue sheet supported by a papermaking fabric, said method comprising removing the dried tissue sheet from tile papermaking fabric, transferring the dried sheet from the papermaking fabric to a steel calender roll via a vacuum transfer roll, passing the sheet through a nip between the steel calender roll and a rubber-covered backing roll, and transferring the calendered sheet, via a second vacuum transfer roll, to a papermaking fabric that carries the calendered sheet to a reel section for winding the sheet into a parent roll, wherein the sheet is supported at all times by a roll surface or a supporting fabric.

12. A method for modifying an uncreped throughdried tissue sheet supported by a papermaking fabric, said method comprising removing the dried tissue sheet from the papermaking fabric, modifying tie tissue sheet in a nip between two rolls, and transferring the modified sheet to a papermaking fabric which carries the sheet to a reel section for winding the sheet into a parent roll, wherein the sheet is supported at all times by a roll surface or a supporting fabric and wherein, upon removal of the dried tissue sheet from the papermaking fabric, said method further comprising passing the tissue sheet over a support surface, passing the sheet through a calendering nip between a steel calendering roll and a rubber-coated backing roll, passing the calendered sheet over a second support surface, and joining the calendered sheet with a papermaking fabric which carries the calendered sheet to the reel section.

13. The method of claim 12 wherein the papermaking fabric from which the dried tissue sheet is removed is the same fabric to which the calendered sheet is joined, which fabric is a throughdrying fabric.

14. A method for modifying an uncreped throughdried tissue sheet supported by a papermaking fabric, contacting the throughdried tissue sheet, while still in contact with the papermaking fabric, with a first calendering roll, separating the tissue sheet from the papermaking fabric, passing the sheet through a nip formed between the first calendering roll and a second calendering roll while traveling in a direction opposite the machine direction of travel, transferring the calendered sheet to the surface of the second calendering roll and reversing the direction of travel of the sheet while in contact with the second calendering roll, separating the calendered sheet from the second calendering roll and joining the calendered sheet with a papermaking fabric that carries the calendered sheet to a reel section for winding the sheet into a parent roll, wherein the sheet is supported at all times by a roll surface or a supporting fabric.

15. The method of claim 14 wherein the first calendering roll is steel and the second calendering roll is backing roll.

16. The method of claim 14 wherein the first calendering roll is a rubber-coated backing roll and the second calendering roll is steel.

17. The method of claim 14 wherein the papermaking fabric from which the dried tissue sheet is separated is the same fabric to which the calendered sheet is joined, which fabric is a throughdrying fabric.

* * * * *